United States Patent [19]

Martin et al.

[11] 4,096,226

[45] Jun. 20, 1978

[54] INTEGRATED SPIN-DRAW-TEXTURIZING PROCESS FOR MANUFACTURE OF TEXTURIZED POLYAMIDE FILAMENTS

[75] Inventors: Wolfgang Martin, Ludwigshafen; Dieter Herion, Frankenthal; Dimiter Bayew, Mannheim; Wolfgang Bauer, Heidelberg, all of Germany

[73] Assignee: BASF Aktiengesellschaft, Rheinland, Pfalz, Germany

[21] Appl. No.: 796,169

[22] Filed: May 12, 1977

Related U.S. Application Data

[63] Continuation-in-part of Ser. No. 320,481, Jan. 2, 1973, abandoned.

[30] Foreign Application Priority Data

Jan. 3, 1972 Germany ..... 2200064

[51] Int. Cl.[2] ..... D01D 5/22; D01D 5/12

[52] U.S. Cl. ..... 264/168; 28/220; 264/290 N, 264/210F

[58] Field of Search ..... 264/176 F, 290 N, 210 F, 264/168; 28/220

[56] References Cited

U.S. PATENT DOCUMENTS 3,216,187 11/1965 Chantry et al. ..... 264/210 F
3,361,859 1/1968 Cerzato ..... 264/176 F
3,861,133 1/1975 Frankfort et al. ..... 28/72.12

*Primary Examiner*—Jay H. Woo
*Attorney, Agent, or Firm*—Keil, Thompson & Shurtleff

[57] ABSTRACT

Integrated process for continuous spinning, drawing and texturizing of synthetic linear high molecular weight polyamide polymers, in which the following steps are effected in immediate succession:

(a) melt-spinning filaments of said synthetic linear high polyamide polymers, preferably poly-ε-caprolactam, at temperatures of between 260° and 295° C and a spin-draw ratio of between 1:10 and 1:60, (b) drawing the spun filaments on at least two forwarding elements, of which the initial element has a surface temperature of between 50° and 120° C and the final element has a surface temperature of between 80° and 350° C, at a draw ratio such that the drawn filament, on leaving the drawing stage, has an extensibility of between 10 and 50% and preferably of between 20 and 35%, and (c) texturizing said filaments at a velocity of between 800 and 3,000 m/min by an air jet process and preferably between 1,600 and 2,000 m/min, the overfeed in the texturizing stage being from 10 to 50% at a filament temperature, prior to texturization, of between 50° and 180° C and preferably of between 100° to 130° C.

7 Claims, 1 Drawing Figure

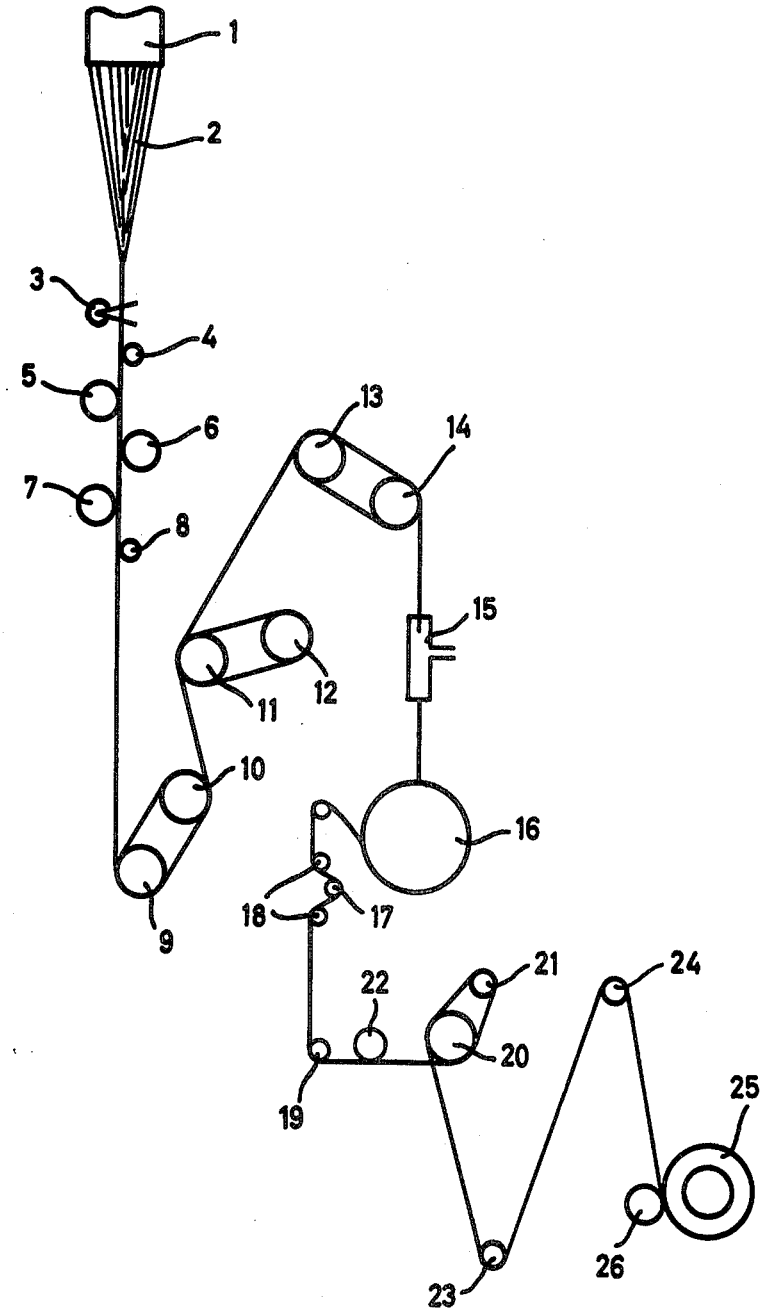
1
2
3
4
5
6
7
8
9
10
11
12
13
14
15
16
17
18
19
20
21
22
23
24
25
26

INTEGRATED SPIN-DRAW-TEXTURIZING PROCESS FOR MANUFACTURE OF TEXTURIZED POLYAMIDE FILAMENTS

This application is a continuation-in-part of Ser. No. 320,481 filed Jan. 2, 1973 now abandoned.

The present invention relates to an integrated spin-draw-texturizing process for producing texturized polyamide filaments in a single operation and at a high output rate.

Apart from the conventional methods of making texturized filaments in three separate stages, namely spinning, drawtwisting or draw-winding, and texturizing, integrated processes such as spin-draw-winding or draw-texturizing have been adopted in practice. However, these integrated processes suffer from the drawback that a winding stage is always necessary between the spinning and texturizing stages. This winding process has a detrimental effect on the uniformity of the quality of the yarn. The up-and-down motion of the filament during winding causes differences in pre-orientation of the yarn at the reversal points of the thread guide. Furthermore, the thickness of the layer of finish applied to the filament cannot be maintained absolutely constant due to centrifugal effects occurring on account of the up-and-down motion of the filament and also due to diffusional effects in the package. These differences in preorientation in the yarn lead, in high-quality yarns, to variations in dyeability and to reduced tensile strength of the texturized yarn. Variations in the thickness of the finish lead to difficulties during texturization when carried out, for example, by the false-twist or stuffer-box method and particularly in the case of friction crimping techniques.

The use of a winding stage between spinning and texturization gives rise to other difficulties such as storage problems. Another fact which cannot be ignored is the possibility of mechanical damage to the packages during transport from one processing stage to the next. Finally, processes carried out in separate stages are unsatisfactory from an economical point of view.

There has been no lack of attempts to develop methods in which the above steps are fully integrated. An example of such a spin-draw-texturizing process is described in German Published Application No. 1,902,213. In this process, the filament leaving a spinning machine is passed, after solidification, over a cooling godet and is then drawn and finally crimped and fixed in a subsequent process. Apart from the subsequent fixing process, this method has the disadvantage that the cooling godet must be positioned at a suitable distance from the spinneret depending, for example, on the denier of the filament, the speed of withdrawal, the rate of extrusion and the ambient temperature. It is thus necessary to re-position the cooling godet whenever filaments of a different denier are to be produced or the spinneret hole size is changed. Since the cooling godet must be adjusted to a temperature just above the dew point, conditions in the proximity of the godet must be very accurately controlled. Furthermore, fixing of the position of the stretch point on the cold godet is difficult and this leads to further reduction in the uniformity of the yarn and to capillary cracks. Finally, this method of producing a more or less latent crimp, as in the case of bicomponent yarns, produces a relatively weak crimp showing a relatively low second modulus of the stress-strain curve in the decrimping region.

In another process (U.K. Pat. No. 1,170,749) for integrated spinning and texturizing of synthetic yarns, an aspirator jet is provided below the spinneret to effect stretching of the yarn bundle. In this process, stretching is not uniform or complete, as is readily seen from the high extensibilities given of at least 61%, and the process is thus not suitable for the manufacture of high-quality texturized yarns.

Another spin-draw-texturizing process (French Pat. No. 1,535,468) makes use of a stuffer-box or false-twist texturizing technique and is thus restricted to uneconomically low speeds. Finally, French Pat. No. 1,555,112 describes an air-blowing process permitting integrated spinning, drawing and texturizing of cellulose acetate yarn or nylon yarn. The process suffers from the drawback that two separate nozzle systems must be used and the process is restricted to rates in the region of 500 m/min due to the shape of the nozzles.

Finally U.S. Specification No. 3,861,133 describes a continuous and integrated process for the production of highly crimped polyester yarn. This process uses air jets for drawing, heating, bulking, but for texturizing the yarn a pin is used.

It is an object of the invention to provide an integrated spinning, drawing and texturizing process which produces crimped filaments showing highly uniform dyeability. It is a further object of the invention to provide a process for the manufacture of crimped filaments having more uniform strength and modulus of elasticity over their entire length.

These objects are achieved in a process for the manufacture of a texturized yarn by continuous melt-spinning, drawing and texturizing of a fiber forming synthetic linear high molecular weight polymer selected from the group consisting of ϵ-polycaprolactam and polyhexamethylene adipamide, said process comprising the following steps in immediate succession:

(a) melt-spinning of filaments of said fiber forming polymers, at temperatures of between 260° and 295° C and preferably of between 275° and 285° C, and at a spin-draw melt attenuation ratio of between 1:10 and 1:60 and preferably of between 1:20 and 1:40, (b) drawing of the spun filaments only on forwarding elements for development of a uniform tensile strength and modulus of elasticity, said spun filaments being collected as a bundle leaving the melt-spinning stage and directly wound on at least two forwarding elements, of which the initial element has a surface temperature of between 50° and 120° C and the final element has a surface temperature of between 80° and 350° C and preferably of between 140° to 180° C, at a draw ratio such that the drawn filament, when leaving the drawing stage, has an extensibility of between 10 and 50% and preferably between 20 and 35%, and (c) air-texturizing said filament as a collected yarn leaving the drawing stage at a velocity of between 800 and 3,000 m/min and preferably between 1,600 and 2,000 m/min, the overfeed in the texturizing stage being from 10 to 50% and preferably from 25 to 35% at a filament temperature, prior to texturization, of between 50° and 180° C and preferably of between 100° and 130° C, the spinning, drawing and texturizing yielding a yarn with a total final denier of from 100 to 3,600 dtex and an individual filament denier of from 3 to 30 dtex.

This process is suitable for the said fiber-forming synthetic linear high molecular weight polymers such as nylon 6 (poly-ϵ-caprolactam) or nylon 6.6 (polyhexamethylene adipamide), which polyamides may be modified by additives or by comonomers. The process has been found to be particularly suitable for application to poly-ε-caprolactam having a relative viscosity (measured on a solution of 1 g of poly-ε-caprolactam in 100 ml of 96% sulfuric acid at 25° C) of between 2.3 and 3.5 and preferably of between 2.4 and 3.2.

The polymers are first melt-spun at temperatures of from 260° to 295° C and preferably from 275° to 285° C. The spin-draw ratio is maintained at from 1:10 to 1:60 and preferably from 1:20 to 1:40. It is advantageous to spin texturized filaments having a total final denier of from 100 to 3,600 dtex and preferably from 800 to 1,600 dtex, the final denier of the individual filaments being from 3 to 30 dtex. The molten filaments are normally cooled by the blowing-air in the cooling cabinets; for heavy deniers an additional cooling is effected by jacketed and water-cooled spinning tubes arranged after the cooling cabinets. It has been found advantageous to give the individual capillary cross-sections of the filaments a polylobate, preferably a trilobate shape. Desirably, the yarn, on leaving the melt-spinning stage and entering the drawing stage, shows shrinkage in boiling water of from −10 to +10% and preferably of from −5 to +5%. Thus the melt-spinning conditions should preferably be adjusted for each material used so as to give said boil-shrinkage.

Melt-spinning is immediately followed by drawing. The filaments are cooled just sufficiently to prevent adhesion of the individual filaments to each other. Drawing is carried out in at least two stages and advantageously in two or three stages, using godets, particularly pairs of godets. In the first state of the drawing process, the degree of drawing achieved should be greater than that in the following stages together.

When drawing in two stages, it is advisable to draw the filaments in the first stage to an extent equal to from two-thirds to three-quarters of the total draw ratio.

The draw ratio is adjusted by controlling the relative speeds of the drawing elements. Very suitable for maintaining an adequately constant temperature are jacketed sealed godets filled with a boiling liquid. By this means it is possible to keep the temperature constant over the whole surface of the godet. Temperature control is effected by a non-touching thermo-element inside the rotating godet. It is important to maintain the correct temperatures in the forwarding elements. The first of such elements or, in the case of more than two stretching elements, the first two stretching elements should have a surface temperature of from 50° to 120° C, whilst the following drawing element should have a surface temperature of from 80° to 350° C and preferably of from 140° to 180° C. The draw ratio should be adjusted so as to give drawn filaments having an extensibility of from 10 to 50% and preferably of from 20 to 35%.

Drawing is immediately followed by air jet texturization or air-blowing processes. Particularly suitable are processes as described in U.S. Specification No. 3,908,248.

The combination of the three processing stages of spinning, drawing and texturizing to form a single operation gives in all cases a distinct improvement in the quality of the texturized filaments as regards their uniformity of dyeability and their uniformity of modulus of elasticity or tensile strength and extensibility. The reduction in strength usually caused by texturization of filaments is considerably lessened by the process of the invention.

Undesirable factors arising from damage to packages by uncontrollable storage factors and also, in particular, arising from irregular winding itself—i.e. differences in pre-orientation and variations of the water and finish contents—as occur in conventional separate processes, have been eliminated. This reduces the number of process-induced yarn breaks to virtually zero.

It is important to maintain the spinning temperatures within the limits defined above because at lower temperatures blowing might occur at the spinnerets due to the resulting higher melt viscosity and higher pressure, whilst at higher temperatures cracked polymer may become deposited at the edges of the spinneret holes to have an undesirable effect on the spinning process.

The process is conveniently carried out so that the calculated temperature differential over the individual capillary cross-sections of the filament bundle on leaving the first forwarding element of the drawing stage is as small as possible. By temperature differential we mean in this case the difference in temperature between the core of the filament and its surface. This end is achieved by passing the filament bundle to the filament guide upstream of the first finish applicator at a temperature which is just below that at which surface sticking of the filaments still occurs. Furthermore, the forwarding elements in the drawing stage are heated pairs of rolls, which measure obviates a temperature differential such as occurs when using one heated godet and one unheated idler roll.

The accompanying drawing shows a thread flow diagram typical of the process of the invention.

A filament bundle 2 leaving spinneret 1 travels past a cutter 3, a filament guide 4, finish applicators 5, 6 and 7 and a filament guide 8 to reach a first pair of godets 9, 10. The yarn is wound around said godets a number of times and then passed on to a second pair of godets 11, 12 and then to a third pair 13, 14, the yarn being wound around each pair a number of times. The yarn then passes to a texturizing unit 15, from which the texturized yarn is loosely discharged in crimped form onto a rotating cooling drum 16. The yarn is removed from said cooling drum via brake bars 18 and guide roll 19 by a delivery roll 20 having an idler roll 21 enabling the yarn to be wound around the unit a number of times. Near the brake bars 18 there is provided a movable yarn controller 17 which actuates the cutter 3 should a break in the yarn occur. Upstream of delivery roll 20 there may be installed a jet marking device 22, which will be used for example in the manufacture of carpet yarns. At this point it is also possible to apply spooling oils or lubricants. Finally, the yarn passes over a dancing roll 23 of a tension-controlled winding unit and over a guide roll 24 to a windup roll 25. A sensing roll 26 effects coarse control of the speed of rotation of roll 25.

In the following Examples the advantages of the process of the invention (Example 1) are clearly shown in comparison with a prior art process (Example 2).

EXAMPLE 1

Nylon 6 having a relative viscosity of 2.78 (measured in 96% sulfuric acid) and having a titanium dioxide content of 0.2% is spun from the melt at a temperature of 285° C and at a rate of 600 m/min to form a yarn having a denier of 3,800 dtex f 68, the spin-draw ratio being 1:32. The yarn is immediately drawn by means of three pairs of rollers, the temperature of the first pair being 92° C, that of the second pair being 98° C and that of the third pair being 185° C. The draw ratio between the first and second pairs is 1:2.6 and that between the second and third pairs is 1:1.33 so that a total draw ratio of 1:3.45 is achieved. The speed of the drawn yarn leaving the final pair of godets is 2,050 m/min. Drawing is immediately followed by texturization in an apparatus such as is described in U.S. Specification No. 3,908,248, at a temperature of 390° C and an air rate of 10.29 $m^3$/hr. The resulting yarn has the following characteristics:

| characteristics: | |
|---|---|
| tensile strength (g/dtex) | 3.07 |
| coefficient of strength variation (%) | 1.53 |
| extensibility (%) | 45.5 |
| coefficient of extensibility variation (%) | 3.38 |
| crimp contraction (%)+ | 12.1 |
| coefficient of crimp contraction variation (%) | 2.3 |
| dye affinity for strongly staining metal complex dye (K/S %)++ | 118 |
| coefficient of variations in dye affinity over 40 successively knitted tubes as measured by the above dyeing method (%)++ | 2.63 |

+Determination of the crimp contraction is effected by measuring the length of a thoroughly wetted specimen of the yarn under two different loads. The difference in length divided by the longer of these stretched lengths gives the crimp contraction:

$$\frac{L_1 - L_2}{L_1} \times 100 = \text{crimp contraction in } \%$$

Before this measurement, the strand of texturized yarn is laid in water at room temperature for 10 minutes in a relaxed state. It is then removed from the water and loaded with a weight of 0.045 g/dtex and then with a weight of 0.009 g/dtex to give the lengths $L_1$ and $L_2$ respectively.

++The depth of color of the knitted tubes was measured using the photo-electric reflectance photometer ELREPHO by Zeiss, Oberkochen, Germany. From the reflectance values R indicated by this apparatus the value $$\frac{K}{S} = \frac{(1 - R)^2}{2R}$$

was calculated with the aid of the Kubelka-Munk function, the K/S value of a specimen being given as a percentage of the K/S value of a standard.

EXAMPLE 2

If the process is carried out in a conventional manner, i.e. by collecting the fresh yarn spun from the melt and winding it on a bobbin and then subjecting it to a draw-texturing process in a separate state in the usual manner at a first godet temperature of 80° C and a second godet temperature of 105° C at a draw ratio of 1:3.5, causing the yarn to leave the second godet at a speed of 800 m/min and passing to the texturizing apparatus operated, on account of the slow rate, at 280° C and an air rate of 5.19 $m^3$/hr, a yarn having the following characteristics is obtained:

| | |
|---|---|
| tensile strength (g/dtex) | 2.85 |
| coefficient of stength variation (%) | 2.95 |
| extensibility (%) | 43 |
| coefficient of extensibility variation (%) | 4.62 |
| crimp contraction (%) | 12.9 |
| coefficient of crimp contraction variaton (%) | 3.75 |
| dye affinity for strongly staining metal complex dye (K/S %) | 112 |
| coefficient of variations in dye affinity over 40 successively knitted tubes as measured by the above dyeing method (%) | 3.37 |

We claim:

1. In an integrated process for the manufacture of a texturized yarn by a continuous melt-spinning, drawing and texturizing of a fiber-forming synthetic linear high molecular weight polymer selected from the group consisting of poly-ε-caprolactam and polyhexamethylene adipamide wherein the steps of spinning, drawing and texturizing are combined in immediate succession, the improvement which comprises:

a. melt-spinning filaments of said fiber-forming polymer at a temperature of between 260° C and 295° C and at a spin-draw melt attenuation ratio of between 1:10 and 1:60;

b. drawing the spun filaments only on forwarding elements for the development of a uniform tensile strength and modulus of elasticity, said spun filaments being collected as a bundle leaving the melt-spinning stage and directly wound on at least two forwarding elements, of which the initial elements have a surface temperature of between 50° C and 120° C and the final element has a surface temperature of between 80° C and 350° C at a draw ratio such that the drawn filaments on leaving the drawing stage, have an extensibility of between 10 and 50%; and c. air-texturizing said filaments as a collected yarn leaving the drawing stage at a velocity of between 800 and 3,000 m/min, the overfeed in the texturizing stage being from 10 to 50% at a filament temperature, prior to texturization, of between 50° C and 180° C, the spinning, drawing and texturizing yielding a yarn with a total final denier of from 100 to 3,600 dtex and an individual filament denier of from 3 to 30 dtex.

2. A process as claimed in claim 1 in which the linear high polymer is poly-ε-caprolactam.

3. A process as claimed in claim 2, in which a poly-ε-caprolactam having a relative viscosity, measured on a solution of 1 g of poly-ε-caprolactam in 100 ml of 96% sulfuric acid at 25° C of between 2.3 and 3.5 is used.

4. A process as claimed in claim 1, in which the capillary cross-section of the individual filaments has a polylobate shape.

5. A process as claimed in claim 1, in which the undrawn yarn has a shrinkage in boiling water of between −10 and +10%.

6. A process as claimed in claim 1, in which the filaments are drawn in two stages, the amount of drawing in the first stage being from two-thirds to three-quarters of the total draw ratio.

7. A process as claimed in claim 1 wherein the spin-draw melt attenuation ratio is from 1:20 to 1:40, the final forwarding element has a surface temperature of from 140° to 180° C, and the draw ratio in step (b) is sufficient to give the drawn filaments an extensibility of from 20 to 35%.

* * * * *

REEXAMINATION CERTIFICATE (992nd)

United States Patent [19]

Martin et al.

[11] B1 4,096,226

[45] Certificate Issued Jan. 17, 1989

[54] INTEGRATED SPIN-DRAW-TEXTURIZING PROCESS FOR MANUFACTURE OF TEXTURIZED POLYAMIDE FILAMENTS

[75] Inventors: Wolfgang Martin, Ludwigshafen; Dieter Herion, Frankenthal; Dimiter Bayew, Mannheim; Wolfgang Bauer, Heidelberg, all of Fed. Rep. of Germany

[73] Assignee: BASF Aktiengesellschaft, Rheinland, Pfalz, Fed. Rep. of Germany

Reexamination Request:
No. 90/001,269, Jun. 26, 1987

Reexamination Certificate for:

| | |
|---|---|
| Patent No.: | **4,096,226** |
| Issued: | **Jun. 20, 1978** |
| Appl. No.: | **796,169** |
| Filed: | **May 12, 1977** |

Related U.S. Application Data

[63] Continuation-in-part of Ser. No. 320,481, Jan. 2, 1973, abandoned.

[30] Foreign Application Priority Data

Jan. 3, 1972 [DE] Fed. Rep. of Germany ..... 2200064

[51] Int. Cl.[4] ..... D01D 5/22; D01D 5/12

[52] U.S. Cl. ..... 264/168; 28/220; 264/210.2; 264/210.8

[58] Field of Search ..... 264/168, 210.2, 210.8, 264/134, 211.12, 555, 102, 290.5; 28/220

[56] References Cited

U.S. PATENT DOCUMENTS

| | | |
|---|---|---|
| 3,216,187 | 11/1965 | Chantry et al. . |
| 3,271,943 | 9/1966 | Williams . |
| 3,361,859 | 1/1968 | Cenzato . |
| 3,543,358 | 12/1970 | Breen et al. . |
| 3,846,532 | 11/1974 | Kubitzker et al. . |
| 3,861,133 | 1/1975 | Frankfort et al. . |
| 4,042,662 | 8/1977 | Corbin et al. . |

FOREIGN PATENT DOCUMENTS

| | | |
|---|---|---|
| 1904234 | 8/1970 | Fed. Rep. of Germany . |
| 2122748 | 11/1971 | Fed. Rep. of Germany . |
| 0027778 | 8/1971 | Japan . |

OTHER PUBLICATIONS

*Angewandte Chemie*, 74, 1962, pp. 562–569 (English translation attached).

*Primary Examiner*—Hubert C. Lorin

[57] ABSTRACT

Integrated process for continuous spinning, drawing and texturizing of synthetic linear high molecular weight polyamide polymers, in which the following steps are effected in immediate succession:

(a) melt-spinning filaments of said synthetic linear high polyamide polymers, preferably poly-ε-caprolactam, at temperatures of between 260° and 295° C. and a spin-draw ratio of between 1:10 and 1:60, (b) drawing the spun filaments on at least two forwarding elements, of which the initial element has a surface temperature of between 50° and 120° C. and the final element has a surface temperature of between 80° and 350° C., at a draw ratio such that the drawn filament, on leaving the drawing stage, has an extensibility of between 10 and 50% and preferably of between 20 and 35%, and (c) texturizing said filaments at a velocity of between 800 and 3,000 m/min by an air jet process and preferably between 1,600 and 2,000 m/min, the overfeed in the texturizing stage being from 10 to 50% at a filament temperature, prior to texturization, of between 50° and 180° C. and preferably of between 100° to 130° C.

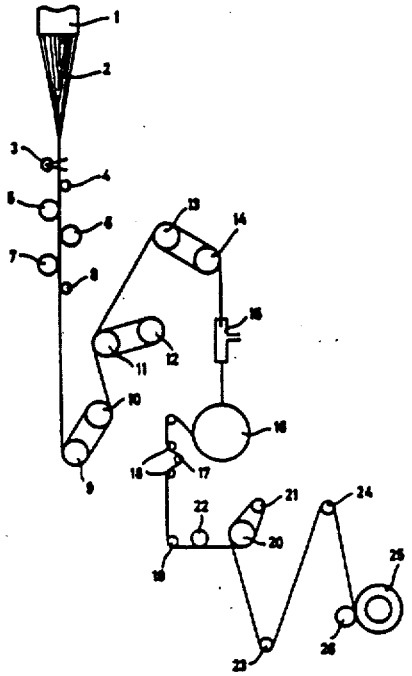

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 3 and 7 are cancelled.

Claim 1 is determined to be patentable as amended.

Claims 4–6, dependent on an amended claim, are determined to be patentable.

New claim 8 is added and determined to be patentable.

1. In an integrated process for the manufacture of a texturized *nylon 6* yarn by [a] *the* continuous melt-spinning, drawing and texturizing of [a fiber-forming synthetic linear high molecular weight polymer selected from the group consisting of poly-ε-caprolactam and polyhexamethylene adipamide] *nylon 6 having a relative viscosity, measured on a solution of 1 g of nylon 6 in 100 ml of 96% sulfuric acid at 25° C., of between 2.4 and 3.2* wherein the steps of spinning, drawing and texturizing are combined in immediate succession, the improvement which comprises:

a. melt-spinning filaments of [said fiber-forming polymer] *nylon 6* at a temperature of between 260° C. and 295° C. and at a spin-draw melt attenuation ratio of between [1:10 and 1:60] *1:20 and 1:40;* b. drawing the spun filaments only on forwarding elements for the development of a uniform tensile strength and modulus of elasticity, said spun filaments being collected as a bundle leaving the melt-spinning stage and directly wound on at least two forwarding elements, of which the initial elements have a surface temperature of between 50° C. and 120° C. and the final element has a surface temperature of between 80° C. and 350° C. at a draw ratio such that the drawn filaments on leaving the drawing stage, have an extensibility of between 10 and 50%; and c. air-texturizing said filaments as a collected yarn leaving the drawing stage at a velocity of between 800 and 3,000 m/min, the overfeed in the texturizing stage being from [10 to 50%] *25 to 35%* at a filament temperature, prior to texturization, of between 50° C. and 180° C., the spinning drawing and texturizing yielding a yarn with a total final denier of from 100 to 3,600 dtex and an individual filament denier of from 3 to 30 detex.

*8. A process as claimed in claim 1, wherein the final forwarding element has a surface temperature of from 140° to 180° C.*

* * * * *